US012631412B2

(12) United States Patent
Puha

(10) Patent No.: US 12,631,412 B2
(45) Date of Patent: May 19, 2026

(54) TAPERED BARREL GUIDES FOR FIREARMS

(71) Applicant: Eight Holdings LLC, Coeur d'Alene, ID (US)

(72) Inventor: Teodor Puha, Coeur d'Alene, ID (US)

(73) Assignee: EIGHT HOLDINGS LLC, Coeur d'alene, ID (US)

( * ) Notice: Subject to any disclaimer, the term of this patent is extended or adjusted under 35 U.S.C. 154(b) by 0 days.

(21) Appl. No.: 18/808,769

(22) Filed: Aug. 19, 2024

(65) Prior Publication Data

US 2025/0060180 A1 Feb. 20, 2025

Related U.S. Application Data

(60) Provisional application No. 63/533,550, filed on Aug. 18, 2023.

(51) Int. Cl.
*F41A 5/14* (2006.01)
*F41A 3/66* (2006.01)

(52) U.S. Cl.
CPC . *F41A 5/14* (2013.01); *F41A 3/66* (2013.01)

(58) Field of Classification Search
CPC ..... F41A 5/14; F41A 3/66; F41A 3/68; F41A 21/00
See application file for complete search history.

(56) References Cited

U.S. PATENT DOCUMENTS

| | | | | |
|---|---|---|---|---|
| 4,677,897 | A * | 7/1987 | Barrett | F41A 19/30 89/198 |
| 11,029,118 | B1 * | 6/2021 | Williams | F41A 3/66 |
| 2020/0191508 | A1 * | 6/2020 | Satzinger | F41C 3/00 |
| 2024/0230256 | A1 * | 7/2024 | May | F41A 3/66 |

* cited by examiner

*Primary Examiner* — J. Woodrow Eldred
(74) *Attorney, Agent, or Firm* — Eric B. Fugett; Mark A. Pitchford; Pitchford Fugett, PLLC

(57) ABSTRACT

A recoil operated gun or firearm utilizes a tapered guide face on a barrel guide and/or a tapered barrel face on a barrel of the gun to realign or zero the barrel relative to a sight device (e.g., optic or iron signs) mounted on the slide or forend supporting the barrel guide.

2 Claims, 9 Drawing Sheets

TAPERED BARREL GUIDES FOR FIREARMS

CROSS-REFERENCE TO RELATED APPLICATIONS

This application is a non-provisional application of and hereby claims priority to U.S. Provisional Patent Application Ser. No. 63/533,550 entitled "TAPERED BARREL GUIDES FOR FIREARMS" filed on Aug. 18, 2023.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FEDERALLY SPONSORED RESEARCH AND DEVELOPMENT

Not Applicable

BACKGROUND OF THE INVENTION

The present invention relates generally to barrel guides for firearms. More particularly, this invention pertains to improving accuracy in firearms via improved barrel guides.

When short recoil gun or firearms are ready to fire, the bolt is locked to the barrel (i.e., chamber at the back of the barrel). Upon firing (i.e., actuation by the trigger group), the bolt and barrel recoil backwards for a distance while continuing to be locked together. At the end of the recoil distance, the bolt unlocks from the barrel, and the bolt continues moving rearward, ejecting a cartridge casing form the chamber, and compressing a recoil spring. The bolt then returns forward under force from the recoil spring, loading a next cartridge into the chamber of the barrel, locking up to the barrel, and returning the barrel to the forward position. Short recoil operated guns have a barrel guide on the front half of the barrel. The barrel guide prevents tilting or binding of the barrel and maintains accuracy. However, a certain amount of clearance and tolerance must be allowed between the barrel guide and the barrel so that the two can move freely relative to one another which means that the starting position or zero of the barrel can shift slightly between each shot. Manufacturing variance and tolerance stacking means that this accuracy variation can vary widely for a given gun design and manufacturing run.

SUMMARY OF THE INVENTION

Aspects of the present invention provide a recoil operated gun or firearm that utilizes a tapered guide face on a barrel guide and/or a tapered barrel face on a barrel of the gun to realign or zero the barrel relative to a sight device (e.g., optic or iron signs) mounted on the slide or forend supporting the barrel guide.

In on aspect of the invention, a gun includes a barrel and a barrel guide. The barrel is configured to extend along a longitudinal axis and reciprocate when the gun is discharged. The barrel has a forward position and a rear position, and the barrel includes a barrel face. The barrel guide includes a guide face. The guide face is configured to contact the barrel face of the barrel when the barrel is in the forward position.

BRIEF DESCRIPTION OF DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
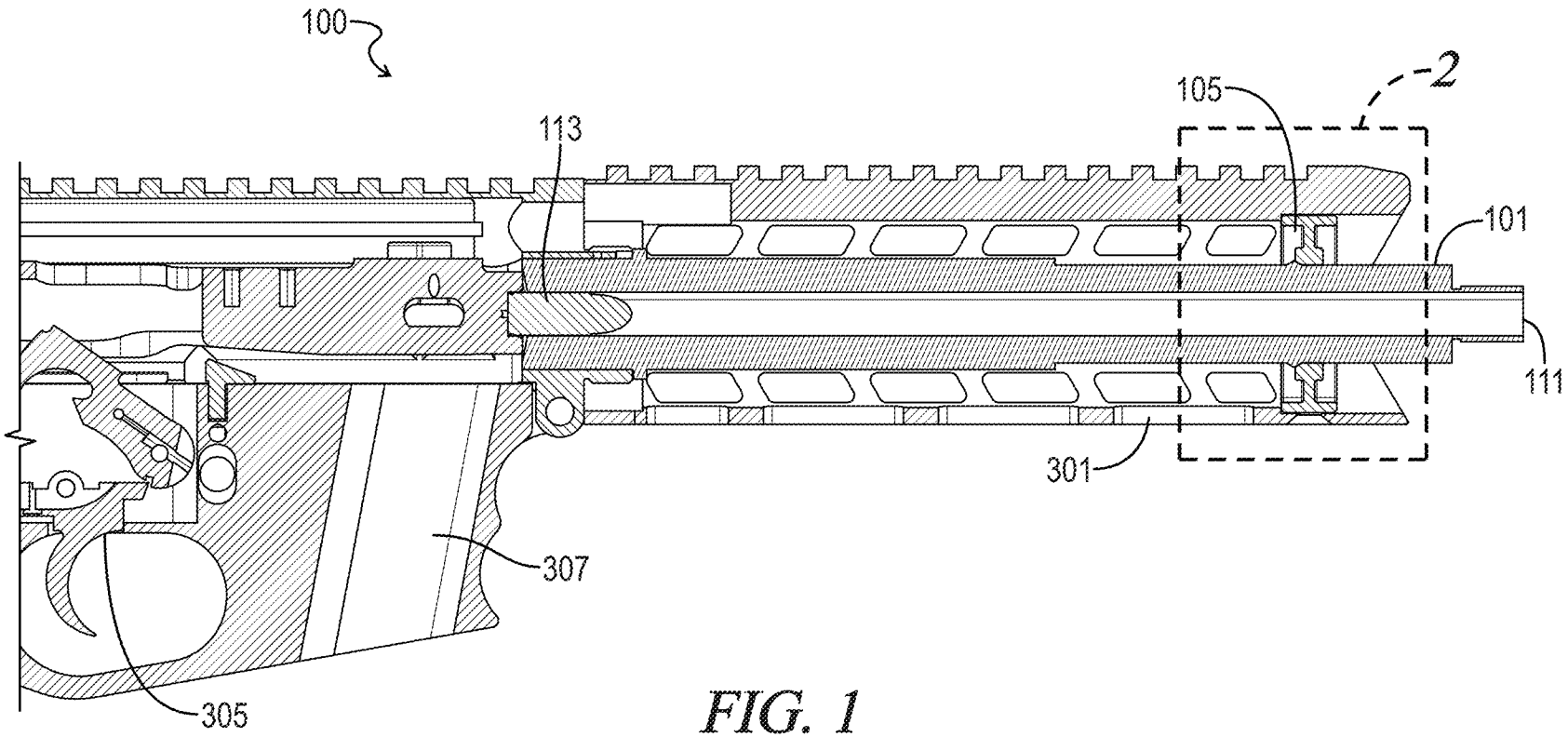
FIG. 1 is a side cutaway view of a gun including a barrel guide with a tapered guide face and a tapered barrel face according to one embodiment of the invention.
Figure 2:
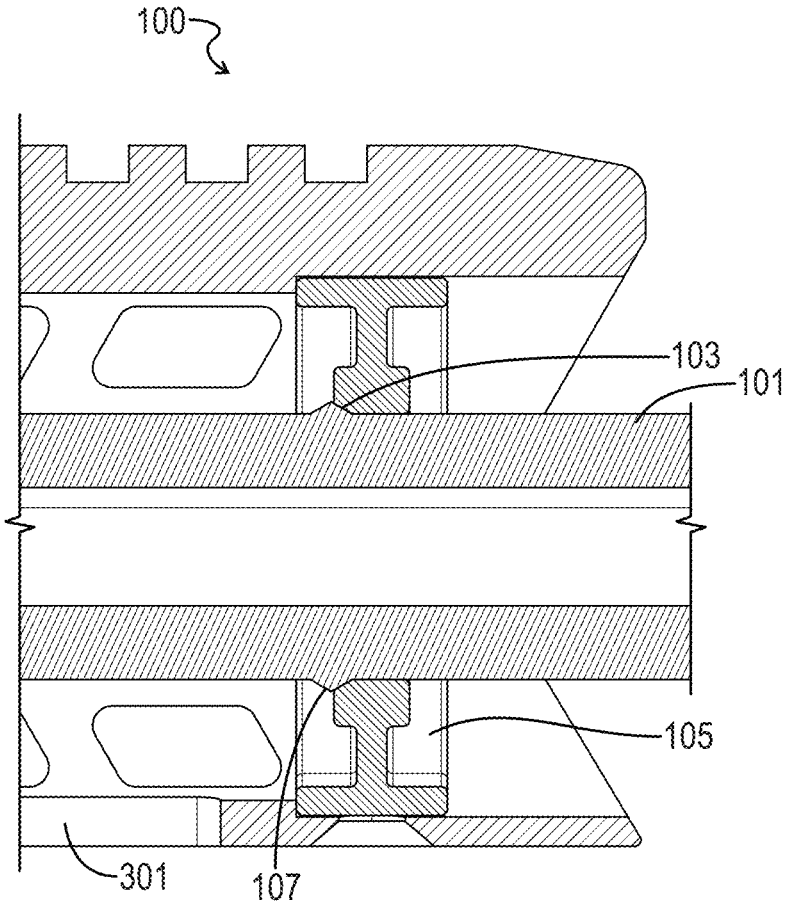
FIG. 2 is a side cutaway view of gun of FIG. 1 with the barrel in the forward position.
Figure 3:
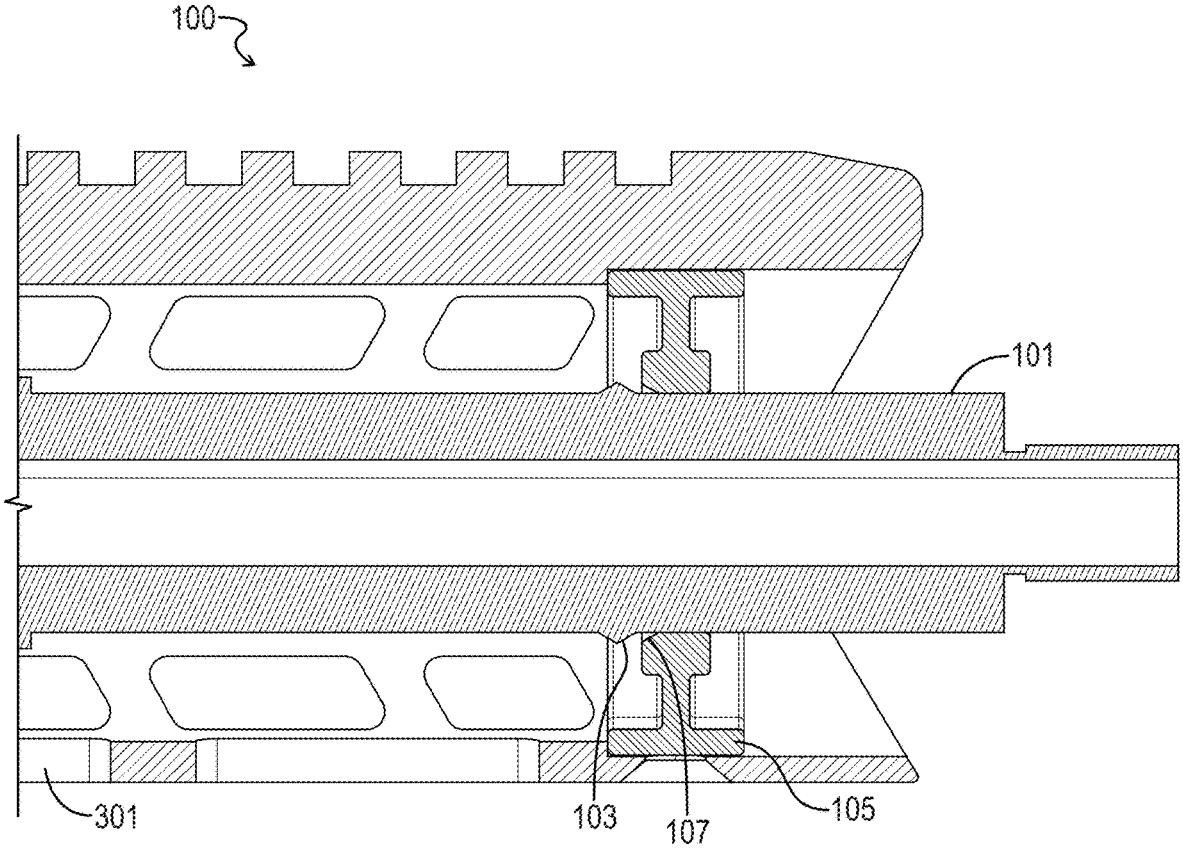
FIG. 3 is a side cutaway view of the gun of FIG. 1 with the barrel in the rear position.
Figure 4:
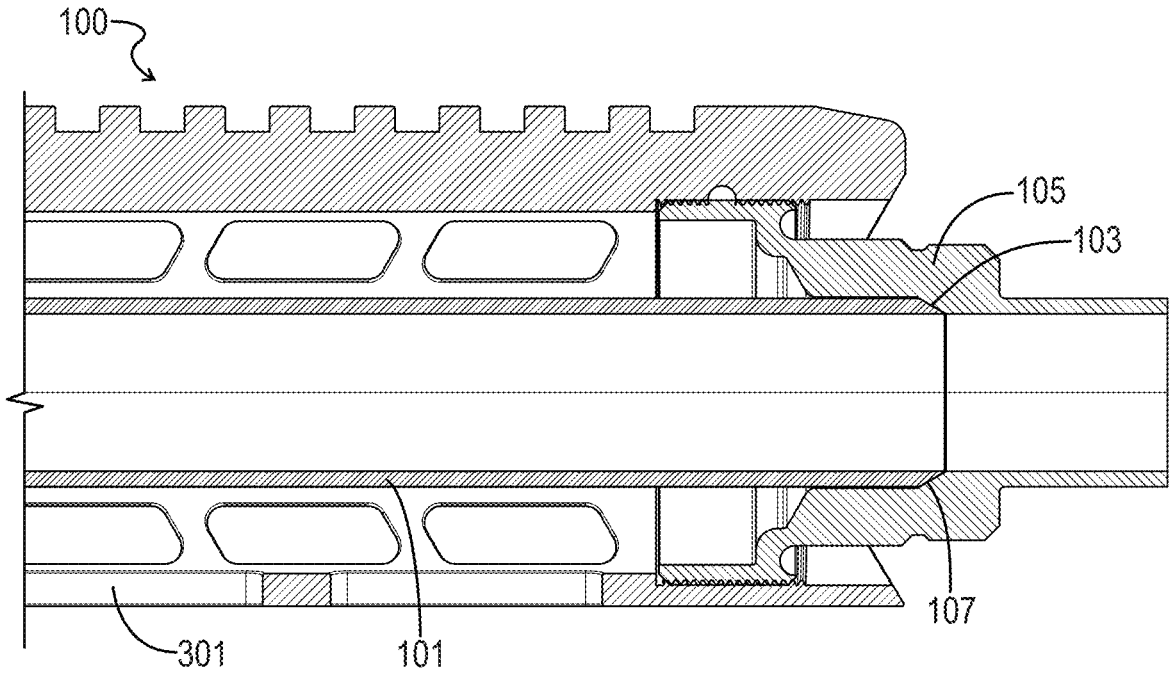
FIG. 4 is a side cutaway view of a gun including a barrel face in the muzzle of the barrel according to another embodiment of the invention with the barrel in a forward position of the barrel.
Figure 5:
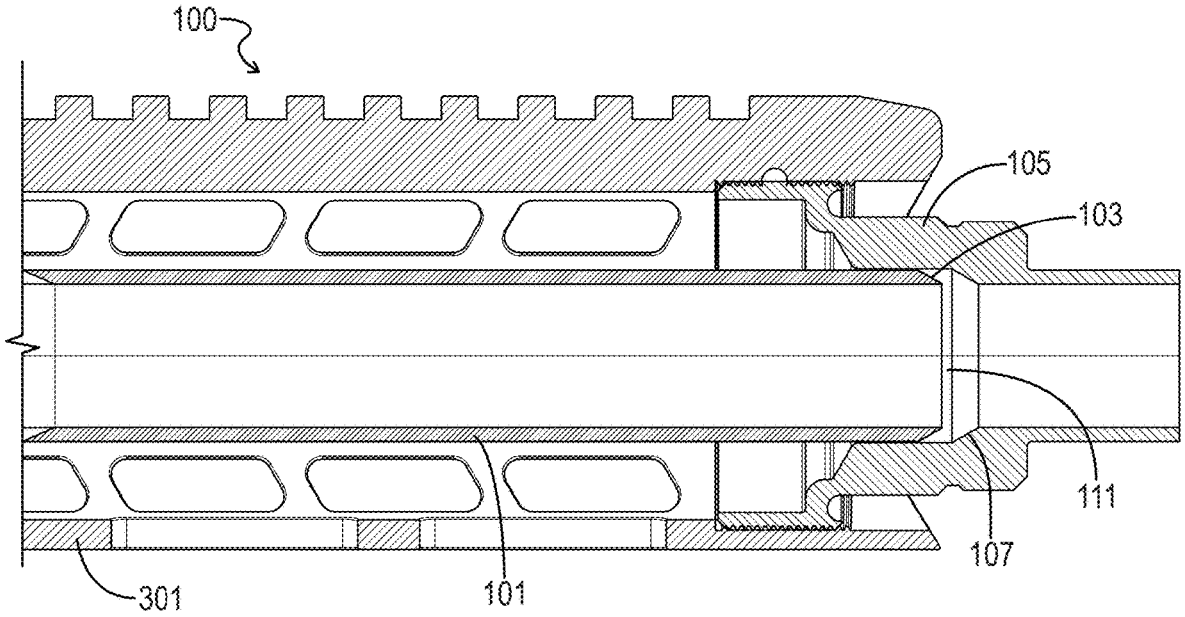
FIG. 5 is a side cutaway view of the gun of FIG. 4 with the barrel in the rear position.
Figure 6:
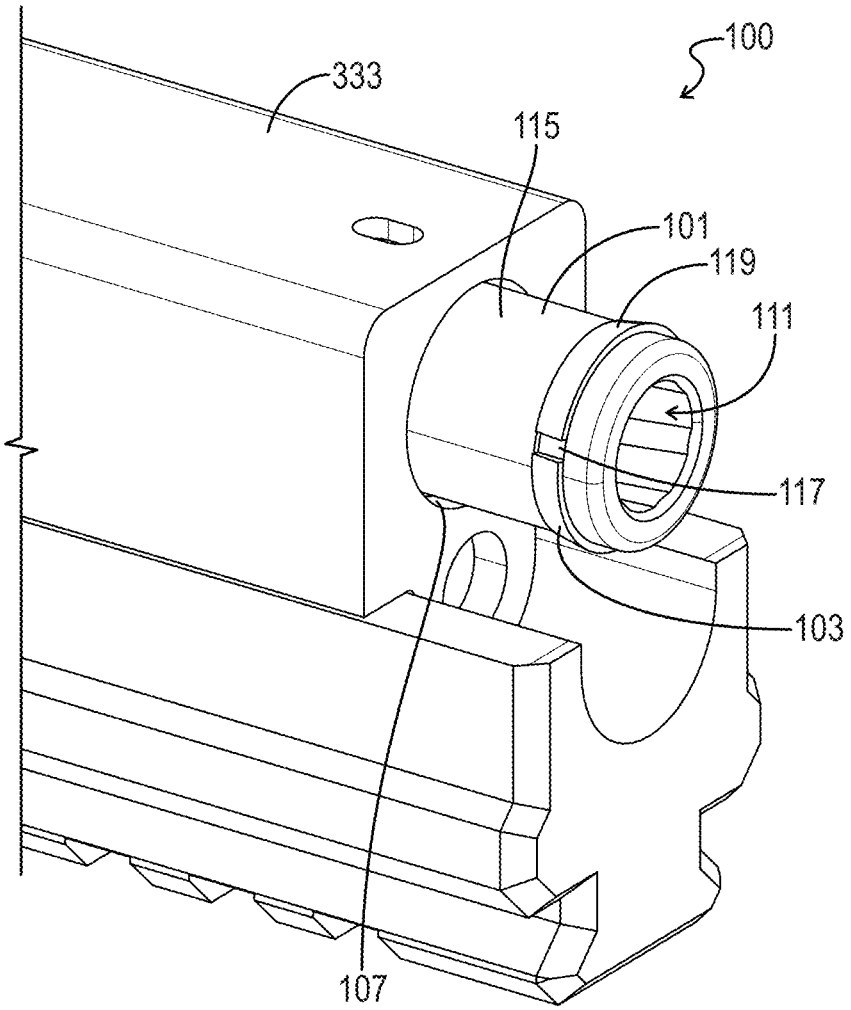
FIG. 6 is an isometric view of a gun (i.e., pistol) with a barrel guide in a groove on the barrel and the slide of the gun in a rear position according to another embodiment of the invention.
Figure 7:
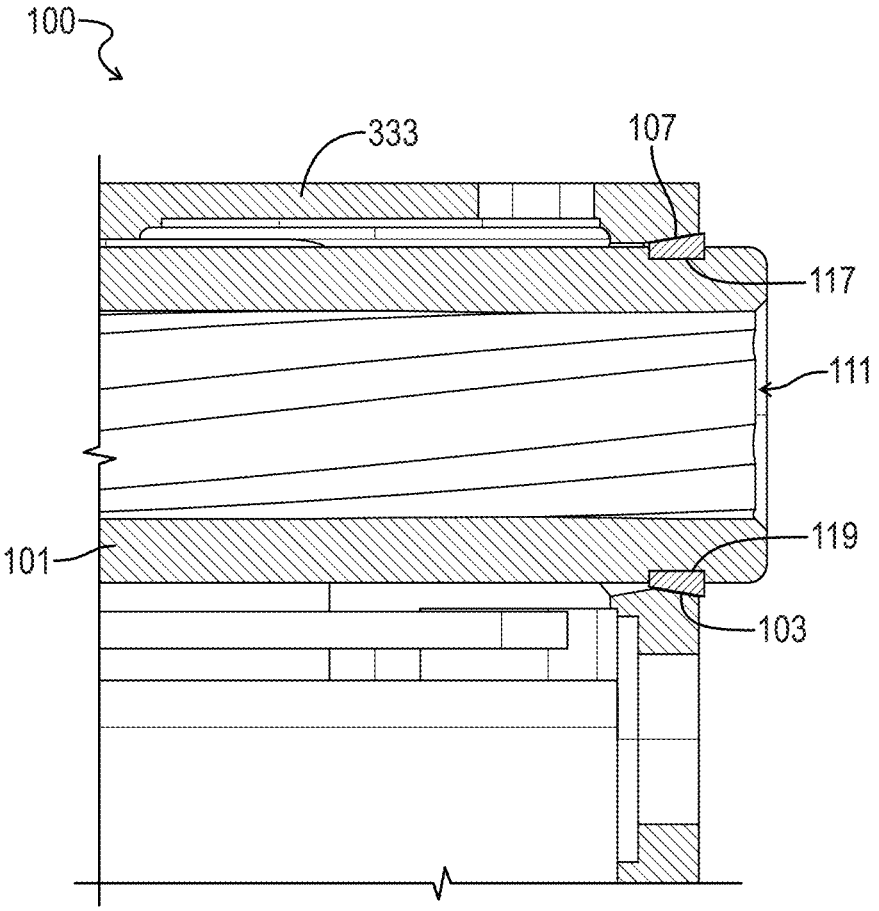
FIG. 7 is a side cutaway view of the gun of FIG. 6 with the slide and barrel in their forward positions.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein, the upright or vertical position of a gun or firearm is when assembled and held by a shooter, ready to shoot (i.e., fire or discharge), with the bore of the barrel of the gun extending generally horizontally or level along a longitudinal axis and the trigger extending generally downward. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

The terms "coupled" and "connected" mean at least either a direct electrical or mechanical connection between the connected items or an indirect connection through one or more passive or active intermediary devices.

Referring to FIGS. 1-7, in one embodiment, a gun 100 includes a barrel 101, and a barrel guide 105. In one embodiment, the gun 100 further includes a forend 301 or slide 303, a trigger group 305, and a receiver 307. The forend 301 or slide 303 is attached to the barrel guide 105 when the gun 100 is assembled. The trigger group 305 is configured to discharge the gun 100. The receiver 307 is configured to support the barrel 101, forend 301 or slide 303, and the trigger group 305. In one embodiment, the gun 100 is recoil operated (e.g., short recoil operated).

The barrel 101 is configured to extend along a longitudinal axis and reciprocate when the gun 100 is discharged such that the barrel 101 has a forward position and a rear position. The barrel 101 includes a barrel face 103. In one embodiment, the barrel face 103 is angled with respect to the longitudinal axis. In one embodiment, a line tangential to the barrel face 103 intersects the longitudinal axis. In one embodiment, the barrel face 103 is closer to a muzzle in of the barrel 101 than to a chamber 113 of the barrel 101. That is, the barrel face 103 is closer to the front end of the gun 100. In one embodiment, the barrel face 103 extends radially outward from an outer surface 115 of the barrel 101. In one embodiment the barrel face 103 is integrally formed with the barrel 101. In another embodiment, the barrel 101 includes a groove 117 in the outer surface 115 of the barrel 101, and the barrel face 103 is a snap ring 119 fitted into the groove 117 when the gun 100 is assembled (see especially FIGS. 6 and 7). In one embodiment, the barrel face 113 is integrally formed with the barrel 101 in the muzzle in of the barrel 101 such that the barrel face 103 does not extend radially outward from the outer surface 115 of the barrel 101 (see especially FIGS. 4 and 5). In one embodiment, the barrel face 103 is flat, and in another, the barrel face 103 is rounded or arcuate. When the guide face 107 is attached to a slide 303, the barrel face 103 has a diameter, width, or height greater at a front of the barrel face 103 than at a rear of the barrel face 103. When the guide face 107 is attached to handguard or forend 301, the barrel face 103 has a diameter, width, or height greater at a rear of the barrel face 103 than at a front of the barrel face 103. That is, the barrel face 103 is tapered.

The barrel guide 105 includes a guide face 107 which is configured to contact the barrel face 103 of the barrel 101 when the gun 100 is assembled and the barrel 101 is in its forward position. In one embodiment, the guide face 107 is angled with respect to the longitudinal axis when the gun 100 is assembled and the barrel 101 is in the forward position. In on embodiment, a line tangential to the guide face 107 intersects the longitudinal axis. In one embodiment, the barrel guide 105 is attached to the handguard or forend 301 when the gun 100 is assembled (see especially FIGS. 1-3). In one embodiment, the guide face 107 extends toward the barrel from a slide 303 or forend 301 of the gun 100 when the gun 100 is assembled. In one embodiment, the barrel guide 105 is attached to the slide 303 extending along the barrel 101 when the gun 100 is assembled (see especially FIGS. 6-7). In one embodiment, the barrel guide 105 is integrally formed with the slide 303 of the gun 100 extending along the barrel 101 when the gun 100 is assembled. In one embodiment, the guide face 107 is flat, and in another, the guide face 107 is rounded or arcuate. When the guide face 107 is supported by or attached to a slide 303, a diameter, height, or width of the guide face 107 is greater at a front end of the guide face 107 than at the rear end of the guide face 107. When the guide face 107 is supported by or attached to a handguard or forend 301, a diameter, height, or width of the guide face 107 is greater at the rear end of the guide face 107 than at the front end of the guide face 107. That is, the guide face 107 is tapered.

In one embodiment, the line along the barrel face 103 and the line along the guide face 107 intersect the longitudinal axis at approximately the same angle. In one embodiment, the barrel face 103 and guide face 107 are complementary. In one embodiment, the barrel face 103 contacts the guide face 107 at at least three points about the barrel 101 when the gun 100 is assembled and the barrel 101 is in the forward position. In another embodiment, the barrel face 103 contacts the guide face 107 substantially continuously about the barrel 101 when the gun 100 is assembled and the barrel 101 is in the forward position. The lines along the guide face 107 and the barrel face 103 are not perpendicular to the longitudinal axis.

Figure 8:
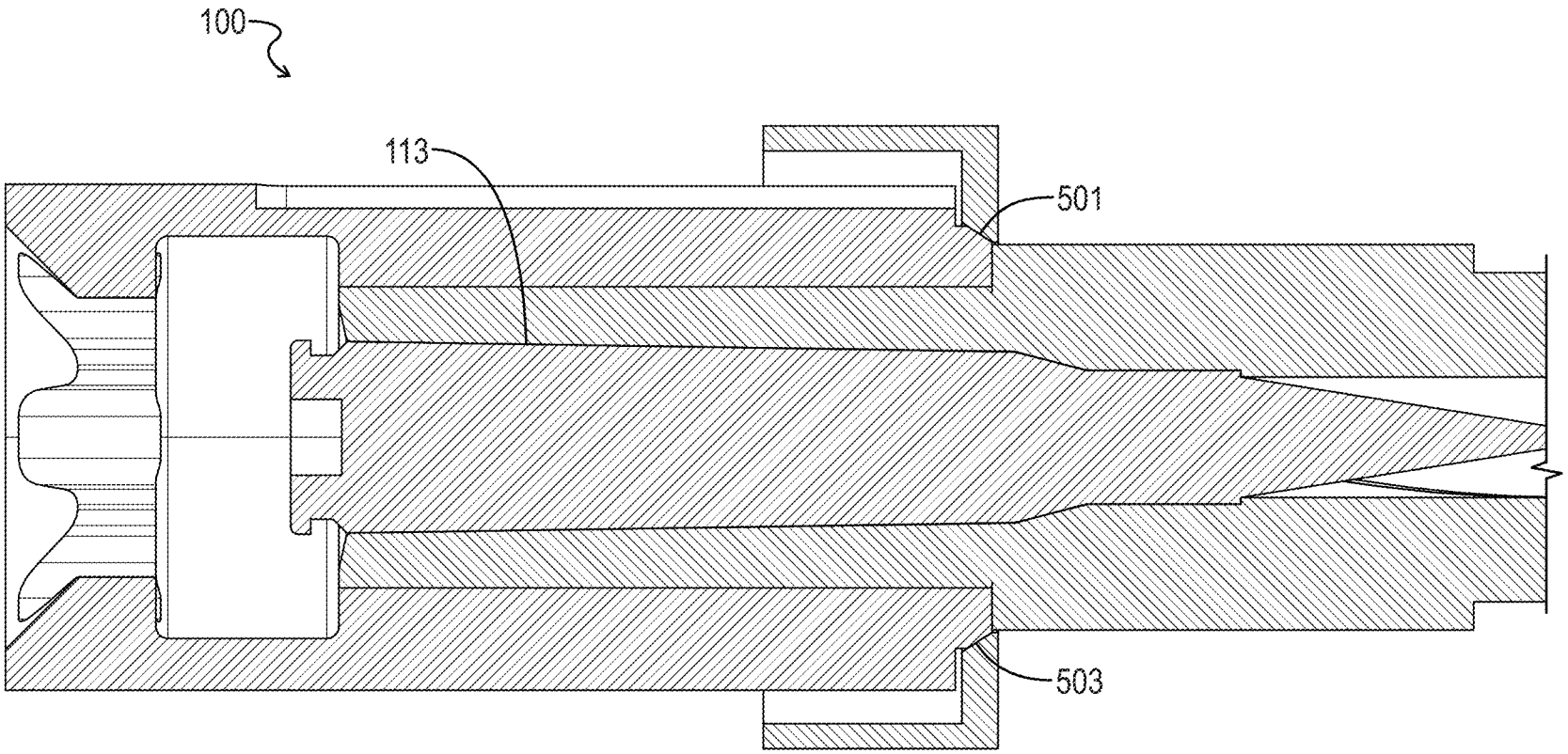
FIG. 8 is a side cutaway view of a gun with a rear barrel face and rear guide face according to another embodiment of the invention.
Figure 9:
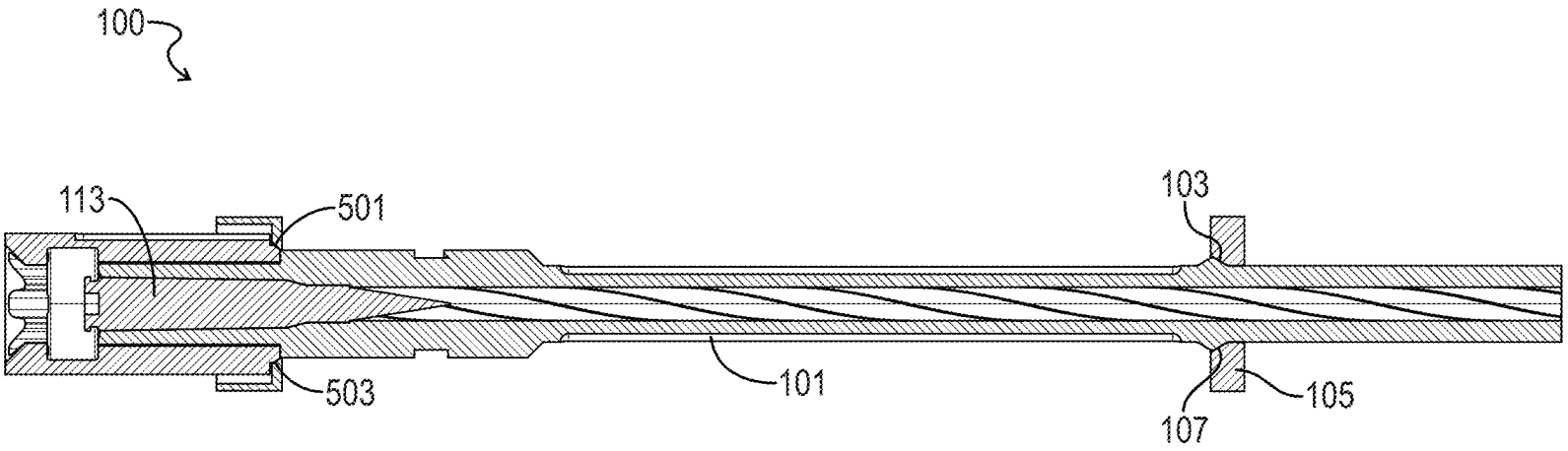
FIG. 9 is a side cutaway view of the gun of FIG. 8.

Referring especially to FIGS. 8 and 9, in one embodiment, the gun 100 further includes a rear barrel face 501 and a rear guide face 503. The rear barrel face 501 and the rear guide face 503 are complementary to one another, and a tangential line through each intersect the longitudinal axis at an angle other than perpendicular.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A gun comprising:

a barrel configured to extend along a longitudinal axis and reciprocate when the gun is fired such that the barrel has a forward position and a rear position, wherein the barrel comprises a barrel face; and a barrel guide comprising a guide face, wherein the guide face is configured to contact the barrel face of the barrel when the barrel is in the forward position;

wherein the barrel face is a snap ring fitted into a groove in an outer surface of the barrel.

2. A gun comprising:

a barrel configured to extend along a longitudinal axis and reciprocate when the gun is fired such that the barrel has a forward position and a rear position, wherein the barrel comprises a barrel face; and a barrel guide comprising a guide face, wherein the guide face is configured to contact the barrel face of the barrel when the barrel is in the forward position;

wherein the barrel face is integrally formed with a muzzle of the barrel such that the barrel face does not extend outwardly from an outer surface of the barrel.

* * * * *